US011168859B2

(12) United States Patent
Lu et al.

(10) Patent No.: US 11,168,859 B2
(45) Date of Patent: Nov. 9, 2021

(54) AUTOMOTIVE LIGHTING SYSTEM FOR VEHICLES

(71) Applicant: Lumileds Holding B.V., Schiphol (NL)

(72) Inventors: Kang Lu, Shanghai (CN); Ping Wu, Shanghai (CN)

(73) Assignee: LUMILEDS LLC, San Jose, CA (US)

( * ) Notice: Subject to any disclaimer, the term of this patent is extended or adjusted under 35 U.S.C. 154(b) by 0 days.

(21) Appl. No.: 16/405,664

(22) Filed: May 7, 2019

(65) Prior Publication Data

US 2019/0346107 A1 Nov. 14, 2019

(30) Foreign Application Priority Data

May 8, 2018 (WO) ..... PCT/CN2018/085970
Jun. 5, 2018 (EP) ..... 18176042

(51) Int. Cl.
*F21S 41/32* (2018.01)
*F21S 41/25* (2018.01)
(Continued)

(52) U.S. Cl.
CPC ..... *F21S 41/32* (2018.01); *F21S 41/148* (2018.01); *F21S 41/25* (2018.01); *F21V 7/06* (2013.01);
(Continued)

(58) Field of Classification Search
CPC ..... F21S 41/663; F21S 41/657; F21S 41/147; F21S 41/148; F21S 41/151; F21S 41/153;
(Continued)

(56) References Cited

U.S. PATENT DOCUMENTS 6,527,411 B1 * 3/2003 Sayers ..... F21S 41/24 362/245
6,948,836 B2 * 9/2005 Ishida ..... F21S 41/147 362/516
(Continued)

FOREIGN PATENT DOCUMENTS

DE 102015224305 A1 6/2017
EP 2784376 A2 10/2014
(Continued)

OTHER PUBLICATIONS

International Preliminary Report on Patentability Chapter I dated Nov. 10, 2020 for PCT International Application No. PCT/EP2019/060871.
(Continued)

*Primary Examiner* — Alexander K Garlen
*Assistant Examiner* — Colin J Cattanach
(74) *Attorney, Agent, or Firm* — Volpe Koenig

(57) ABSTRACT

The present invention relates to the field of automotive lighting, and in particular to an automotive lighting system for a vehicle. The automotive lighting system for a vehicle comprises: a plurality of light sources; a plurality of primary optics, each being a reflector, arranged in a matrix and configured to receive and redirect light from the plurality of light sources; and a secondary optics configured to receive the redirected light from the plurality of primary optics and project the received light in front of the vehicle. Further, each light source is disposed in a focal plane of a corresponding one of the plurality of primary optics, and at least one of the plurality of primary optics is disposed in a focal plane of the secondary optics.

14 Claims, 2 Drawing Sheets

(51) Int. Cl.

| | |
|---|---|
| ***F21S 41/148*** | (2018.01) |
| ***F21V 7/06*** | (2006.01) |
| ***F21Y 115/10*** | (2016.01) |
| ***F21S 41/255*** | (2018.01) |
| ***F21S 41/33*** | (2018.01) |
| ***F21S 41/27*** | (2018.01) |
| ***F21S 41/20*** | (2018.01) |
| ***F21S 41/26*** | (2018.01) |
| ***F21S 41/151*** | (2018.01) |
| ***F21V 7/00*** | (2006.01) |
| ***F21S 41/265*** | (2018.01) |
| ***F21S 41/147*** | (2018.01) |
| ***F21S 41/153*** | (2018.01) |
| ***F21V 13/04*** | (2006.01) |

(52) U.S. Cl.
CPC ..... *F21S 41/147* (2018.01); *F21S 41/151* (2018.01); *F21S 41/153* (2018.01); *F21S 41/255* (2018.01); *F21S 41/26* (2018.01); *F21S 41/265* (2018.01); *F21S 41/27* (2018.01); *F21S 41/285* (2018.01); *F21S 41/33* (2018.01); *F21S 41/334* (2018.01); *F21S 41/335* (2018.01); *F21S 41/336* (2018.01); *F21S 41/337* (2018.01); *F21S 41/338* (2018.01); *F21V 7/0083* (2013.01); *F21V 13/04* (2013.01); *F21Y 2115/10* (2016.08)

(58) Field of Classification Search
CPC ..... F21S 41/25; F21S 41/255; F21S 41/26; F21S 41/265; F21S 41/27; F21S 41/285; F21S 41/33; F21S 41/334; F21S 41/335; F21S 41/336; F21S 41/337; F21S 41/338; F21V 13/04; F21V 7/0083
See application file for complete search history.

(56) References Cited

U.S. PATENT DOCUMENTS

| | | | | |
|---|---|---|---|---|
| 6,953,274 | B2 * | 10/2005 | Rice | B60Q 1/12 362/526 |
| 9,512,978 | B1 * | 12/2016 | Wimberly | F21V 7/041 |
| 10,166,910 | B2 | 1/2019 | Meyrenaud et al. | |
| 10,631,414 | B2 | 4/2020 | Barqueros et al. | |
| 2007/0171650 | A1 * | 7/2007 | Ishida | F21S 41/147 362/307 |
| 2008/0144329 | A1 * | 6/2008 | Okuda | B60Q 1/076 362/539 |
| 2009/0091944 | A1 * | 4/2009 | de Lamberterie | G02B 6/0045 362/516 |
| 2009/0097269 | A1 * | 4/2009 | Stauss | F21V 29/74 362/539 |
| 2011/0122637 | A1 * | 5/2011 | Futami | F21S 41/147 362/519 |
| 2013/0003403 | A1 * | 1/2013 | Takahira | B60Q 1/0023 362/538 |
| 2013/0051014 | A1 * | 2/2013 | Sikkens | F21S 41/36 362/235 |
| 2013/0230306 | A1 * | 9/2013 | Neta | F21V 7/06 396/200 |
| 2014/0009938 | A1 | 1/2014 | Hossfeld | |
| 2014/0092344 | A1 * | 4/2014 | Chi | G02B 6/0088 349/65 |
| 2014/0177253 | A1 * | 6/2014 | Weissenberger | F21S 41/147 362/514 |
| 2014/0307459 | A1 * | 10/2014 | Brendle | F21S 41/143 362/520 |
| 2015/0009698 | A1 * | 1/2015 | Han | F21V 7/0083 362/517 |
| 2015/0043236 | A1 | 2/2015 | Yamamoto | |
| 2015/0131324 | A1 * | 5/2015 | de Lamberterie | F21S 41/322 362/623 |
| 2015/0210209 | A1 * | 7/2015 | Hulse | B60Q 1/2611 362/516 |
| 2015/0241009 | A1 * | 8/2015 | Brendle | F21S 41/143 362/521 |
| 2015/0377453 | A1 * | 12/2015 | Ji | F21S 41/321 362/607 |
| 2017/0146209 | A1 * | 5/2017 | Okubo | F21S 41/00 |
| 2017/0158113 | A1 * | 6/2017 | Kanayama | B60Q 1/0023 |
| 2017/0211775 | A1 * | 7/2017 | Potter | F21S 41/323 |
| 2017/0276311 | A1 * | 9/2017 | Hiki | F21S 41/19 |
| 2018/0112853 | A1 * | 4/2018 | Son | F21S 45/47 |
| 2019/0203903 | A1 * | 7/2019 | Nishimura | B60Q 1/06 |

FOREIGN PATENT DOCUMENTS

| | | |
|---|---|---|
| EP | 2796773 A2 | 10/2014 |
| EP | 3081852 A1 | 10/2016 |

OTHER PUBLICATIONS

International Search Report dated Jul. 23, 2019 for PCT International Application No. PCT/EP2019/060871.

* cited by examiner

AUTOMOTIVE LIGHTING SYSTEM FOR VEHICLES

FIELD OF INVENTION

The present invention relates to the field of automotive lighting. In particular, the present invention is directed to an automotive lighting system, which is suitable for use in a vehicle.

BACKGROUND

With rapid development of the automobile industry, efforts have been paid constantly for obtaining an automotive lighting system, such as an automotive front-lighting lamp, with a simple structure, low cost, and/or high performance.

Typically, a front-lighting system used for vehicles involves various electrical, optical, thermal and/or mechanical parts. In particular, the optical parts are essential for providing front-lighting. However, all the electrical, mechanical and thermal components are necessary for making sure that the optical parts are working properly. For example, electrical circuits can be included in the front-lighting system for supplying energy as required for the optical parts to function. Furthermore, supporting mechanisms may be comprised as well for providing a stable and reliable working environment to the optical parts. As for the thermal constructions, they are beneficial for facilitating heat dissipation.

As one of the dominant designs, a matrix of optics has been proposed for use in the optical portion of an automotive lighting system. For example, in the front-lighting system of an Mercedes Benz CLS, the optical portion comprises a silicone primary optics, a lens, a light guide cover, and an adaptive high beam module. To be specific, as shown in FIG. 1, the silicone primary optics 10 is in a bulk form, where the light exit side 11 is a planar surface, but the light entry side 12 is designed to be in a shape of a comb with multiple comb teeth 120. In other words, the light entry side 12 of the primary optics 10 is shaped such that a plurality of walls is comprised, where each wall is perpendicular to the light exit side 11 and parallel to its neighbor.

As can be seen, the primary optics currently used in Mercedes Benz CLS vehicles involves a complex shaping of the bulk silicone, especially with regard to its light entry side. Besides, in this case, light emitted from the light sources enters the primary optics at the light entry side, propagates through it, and then leaves at the light exit side. This means that light has to be transmitted through the entire bulk silicone, leading to a transmissive type of primary optics. The skilled person in the art understands that the process of transmission involves a relatively large loss of light. Besides, due to the limited sustainability of high intensity light by silicone, the maximal light intensity that is allowed to be transmitted is limited as well.

Somewhat similar to such construction, EP2784376A2 disclosed an array of primary lenses, each being associated with its one light source; and DE102015224305A1 disclosed a primary lens consisting of an array of lens segments with each lens segment being associated with at least one LED of an LED array. While allowing a somewhat more compact structure than the just discussed bulk silicone primary optics these solutions still are transmissive systems with the just discussed drawbacks.

Therefore, it is desirable to provide an automotive lighting system for use in a vehicle, which is simple in structure and easy to manufacture, while still exhibiting high performance and efficiency.

SUMMARY

The present invention provides an automotive lighting system for a vehicle, so as to eliminate or at least alleviate one or more of the above mentioned drawbacks or disadvantages.

In accordance with an embodiment of the present invention, an automotive lighting system is proposed. The automotive lighting system is suitable for use in a vehicle, and comprises a plurality of light sources, a plurality of primary optics, and a secondary optics. The plurality of primary optics is arranged in a matrix. Further, the plurality of primary optics is also configured to receive and redirect light emitted from the plurality of light sources. After redirection by the plurality of primary optics, the redirected light is then received and projected by the secondary optics onto such as a road in front of the vehicle. In the automotive lighting system as proposed above by the present invention, each light source is disposed in a focal plane of a corresponding one of the plurality of primary optics. That is, each light source is used to provide light input for a corresponding primary optics. Besides, among the plurality of primary optics, at least one is disposed in a focal plane of the secondary optics.

As can be seen, in the automotive lighting system as proposed by the present invention, light emitted from the light sources is redirected by the plurality of primary optics first, and then projected by the secondary optics in front of the vehicle. From the imaging point of view, by disposing at least one of the plurality of primary optics in a focal plane of the secondary optics, the part of input beam pattern redirected by each primary optics will be imaged by the secondary optics as a corresponding part of output beam pattern onto the road in front of the vehicle. In other words, each primary optics contributes to a part or, in other words, a pixel of the output beam pattern, thanks to a matrix arrangement of the primary optics. By arranging adjacent primary optics to border on each other directly, the final beam pattern projected onto the road by the secondary optics is ensured to be an intact beam pattern, i.e., without any crevice or gap in the light distribution of the beam pattern. This helps to obtain a favorable front-lighting for the vehicle.

In the automotive lighting system proposed by the present invention, each one of the plurality of primary optics is designed to be a reflector. I.e., the primary optics are all reflectors. Each reflector is configured in such a way that light received from the plurality of light sources is reflected onto the secondary optics.

According to an optional embodiment of the present invention, in the above proposed lighting system, a projection lens is selected for example to be used as the secondary optics. Apparently, those skilled in the art would easily understand that the projection lens is only provided herein as an illustrative example for the secondary optics, and the present invention is not restricted only to it. As a matter of fact, any suitable optics can be used based upon various applications, as long as light redirected by the primary optics can be received and projected in front of the vehicle.

In view of above, according to the present invention, a redirecting type, realized as a reflective type of lighting system is provided in place of the transmissive type of front-lighting system such as that currently used in some Mercedes Benz vehicles. The lighting system can be used for example as a front lamp of the vehicle. By utilizing the redirection, realized as reflection of light emitted from light sources, a simple, compact, and potentially smaller lighting system for vehicles is enabled.

Further, with the plurality of primary optics, realized as reflectors, arranged in a matrix, the resulting beam pattern as projected in front of the vehicle by the projection lens can be changed flexibly in shape and/or light distribution. For example, in an optional embodiment of the present invention, the automotive lighting system further comprises a switching circuit. To be specific, the switching circuit is configured to turn off some of the plurality of light sources such that no light is emitted therefrom. Turn-off of one or more light sources can be accomplished, for example, by sending a turn-off signal from the switching circuit to the one or more light sources. In this case, if the switching circuit never outputs any turn-off signal, the plurality of light sources is all functioning to emit light, resulting in a final beam pattern in a form of matrix as well, just like the matrix distribution of primary optics. Alternatively, in other embodiments, if for example one or more rows of light sources are turned off by the switching circuit or the turn-off signal provided thereby, the resulting beam pattern will therefore not be a complete matrix any more, but missing some bright strips. These strips would otherwise be illuminated if the one or more rows of light sources are not turned off but function well. In this way, various beam patterns with different shapes and/or light distributions can be obtained in front of the vehicle. This helps to provide a resulting beam pattern as desired for the vehicle.

According to an optional embodiment of the present invention, in the above proposed automotive lighting system, one of the plurality of primary optics, i.e., one of the reflectors, is disposed at a focal point of the secondary optics. Further, in this case, all the rest of the plurality of primary optics is disposed optionally in a focal plane of the secondary optics. In a preferred instance, the plurality of primary optics are arranged in a matrix of m rows and n columns, wherein m and n are both integers larger than 1, especially both of them are odd numbers. In this case, the primary reflector located at a center position of the matrix is disposed in a focal point of the secondary optics, e.g. a projection lens, and all the other reflectors are in the corresponding focal plane of the projection lens. In another preferred instance, the plurality of primary reflectors is arranged in an array, i.e., a matrix of 1 row and m columns (or alternatively, m rows and 1 column), wherein m is an integer larger than 1. Further optionally, in the above mentioned lighting system, the reflectors are arranged in one row and m columns, wherein m is an odd number larger than 1. In this case, the reflector at the center position is preferably disposed at a focal point of the projection lens, and all the other reflectors are located in the corresponding focal plane of the projection lens. By disposing the center reflector at the focal point and rendering all the others distributed around the center one, a symmetric beam pattern will be projected, which helps to obtain a favorable front-lighting for vehicles.

According to an optional embodiment of the present invention, in the above proposed automotive lighting system, each light source is disposed at a focal point of a corresponding one of the plurality of primary optics. A focal-point positioning of each light source renders the emitted light therefrom to be used efficiently, and contributes to a higher utilization rate of light emitted by the light sources.

According to an optional embodiment of the present invention, in the above proposed automotive lighting system, at least one of the primary reflectors is designed in a shape of a paraboloid with a rectangle contour. In an example, the rectangle contour has a side length in a range of about 3-15 mm. In case that all of the primary optics are reflectors in a shape of a paraboloid with a rectangle contour, the whole matrix of primary optics may have a total side length of about 50-100 mm. This corresponds to about tens of reflectors. The rectangle contour of each reflector in combination with a regular matrix arrangement of them helps to give a final rectangle beam pattern, as typically required for a front-lighting system of vehicles.

According to an optional embodiment of the present invention, in the above proposed automotive lighting system, the reflector is designed such that a beam pattern, allowing more light near the vehicle than in the far field, is provided after projection by the secondary optics. For example, the reflector can be selected to be a freeform curved reflector, whose curvatures and reflectivity at different positions are specially set such that more light is projected onto the road near the car as compared with that in the far field. This is for example beneficial for a desired low beam pattern.

According to an optional embodiment of the present invention, in the above proposed automotive lighting system, at least one of the plurality of light sources is rotatable for maximizing the light emitted therefrom and impinging onto the plurality of primary optics. To be specific, the at least one light source is rotatable around an axis parallel to a row or column of the matrix of primary optics. By rotating the light source around an axis parallel to a row or column of primary optics, a special orientation of the light source relative to its corresponding reflector will be obtained, whereby the light impinging onto the reflector can be maximized. Typically, the light emitted from a light source such as an LED has a Lambertian distribution of light intensity, where most of the light intensity is distributed within an angle range from −30 degrees to +30 degrees around the normal to its light emitting surface. In view of this, the light source can be rotated such that at least the part of light emission falling within the angle be-tween −30 degrees to +30 degrees around the normal of its light emitting surface impinges on the primary reflector. This helps to improve the utilization of light emitted from the light sources. Apparently, the above description with regard to a Lambertian distribution is only provided to illustrate rather than limit the present invention. A skilled person, having benefits from the teaching of the present disclosure, will easily conceive that light sources other than a Lambertian type can be used as well, and the rotation thereof will be easily understood in a similar way.

According to an optional embodiment of the present invention, in the above proposed automotive lighting system, at least one of the plurality of primary optics has a focal length in a range of 5-10 mm, while the secondary optics may have a focal length in a range of 30-50 mm. It should be noted that all these values provided herein with regard to the focal length of either the primary optics or the secondary optics, are only exemplary, but not limited to the present invention. Other values will be easily conceived by those skilled in the art based on the disclosure of the present disclosure.

According to an optional embodiment of the present invention, in the above proposed automotive lighting system, at least one light source comprises one or more sub-light sources. This means that light can be emitted from one or more sub-light sources onto one corresponding reflector. Optionally, the one or more sub-light sources may be arranged in a subarray or submatrix. Using a plurality of sub-light sources, rather than only one of them to provide light emission for one primary reflector facilitates a higher light input and thus output light intensity. Further, this also helps to avoid an undesired beam pattern projected by the secondary optics if the only one light source, providing the essential portion of light input for one reflector, fails or malfunctions. To be more specific, in case that more than one LED are used for supplying light emission to a corresponding reflector, one LED's failure can be compensated by the rest of operable LEDs, thus never missing any portion of the final beam pattern.

It will be appreciated by those skilled in the art that two or more of the above mentioned embodiments, implementations, and/or aspects of the present invention may be combined in any way deemed useful. Besides, modifications and variations to the automotive lighting system for a vehicle as proposed by the present invention can be carried out by a person skilled in the art on the basis of the current description.

BRIEF DESCRIPTION OF THE DRAWINGS

These and other aspects of the present invention will be described in the following in more detail, with reference to the appended drawings showing embodiments and forming a part of the present invention. Specifically, in the drawings:

FIGS. 4(*a*) and 4(*b*) schematically show a simulated light intensity distribution (or beam pattern) as projected into the far field respectively when all the light sources keep emitting light and when only two of them are turned-on.

DETAILED DESCRIPTION OF THE PREFERRED EMBODIMENTS

Figure 1:
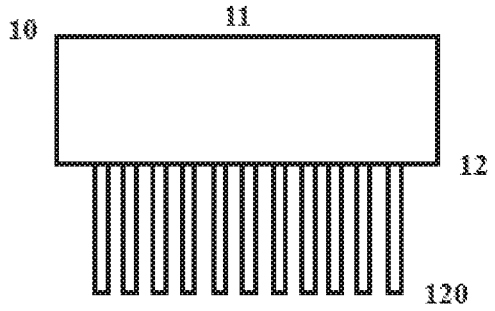
FIG. 1 schematically illustrates a cross section view for one of the conventional primary optics as currently used in some Mercedes Benz vehicles.

While the present invention is susceptible of embodiments in different forms, there is shown in the drawings and will be described in detail hereinafter one or more specific embodiments, with understanding that the present description is to be considered as only exemplary of the basic principle of the present invention and not intended to limit the present invention to any specific embodiments as shown and described herein.

In the following, by referring to FIGS. 2 and 3, a detailed description will be given with regard to the automotive lighting system for a vehicle as proposed in an embodiment of the present invention, where a perspective view and a cross section view are shown respectively in FIGS. 2 and 3 for the automotive lighting system which is suitable for use in vehicles.

Figure 2:
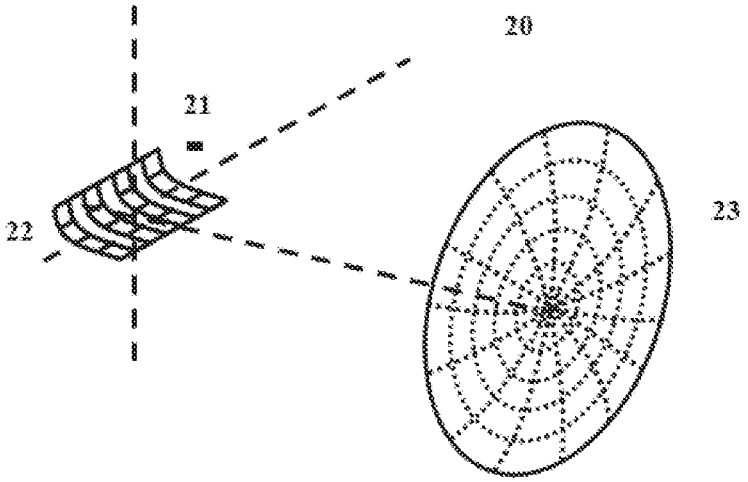
FIG. 2 schematically illustrates a perspective view for an automotive lighting system according to an embodiment of the present invention, where a row of reflectors but only one light source are included so as to not obscure the drawing.

As shown in FIG. 2, the automotive lighting system 20 can comprise specifically a plurality of light sources 21 (where only one of them is depicted for clarity), a plurality of primary optics 21, and a secondary optics 23. As can be seen, the plurality of primary optics 21 are disposed in an array. To be specific, the total number of primary optics 21 as illustrated schematically in FIG. 2 is seven. That is to say, the primary optics 21 is disposed in a 1×7 array. However, as explained above, this specific number of 7 as shown in FIG. 2 should never be deemed in a limited sense for the present invention. As a matter of fact, the plurality of primary optics 21 can be also arranged broadly in a matrix form, where more than one row and more than one column are included. Further, as can be seen in FIG. 2, each of the primary optics 21 is designed to be in a paraboloid form with a rectangle contour. Also, among all these paraboloid primary optics 21 as shown in FIG. 2, all of them are chosen as a reflector. As for positions of the primary optics 21, they are all located in a focal plane of the secondary optics 23. As a preferred instance, only one of the primary optics 21, such as the center one, can be located at a focal point of the secondary optics 23, and the rest are all located around in the corresponding focal plane. Apparently, putting the center primary optics at a focal point of the secondary optics 23 is provided merely as one of numerous implementations for the specific positioning of the primary optics 21. The present invention is susceptible to various alternatives, such as putting a peripheral primary optics at the focal point of the secondary optics 23.

Figure 3:
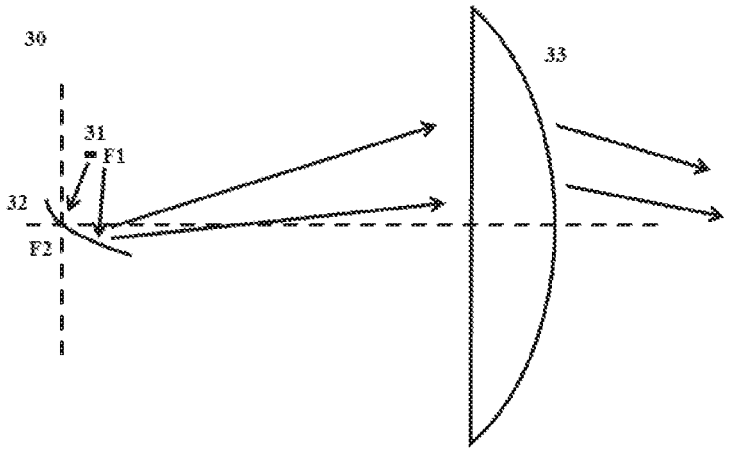
FIG. 3 schematically illustrates a cross section view for an automotive lighting system according to an embodiment of the present invention, where only one reflector and one LED light source are included.

In order to elaborate in more detail about the working process and, specifically, the light propagation within the automotive lighting system 20 as proposed by the present invention, a cross section view of the lighting system 20 is schematically shown in FIG. 3. It should be noted that in FIG. 3, only the primary optics, i.e., reflector 32, located at a center position of the matrix, is illustrated. Moreover, the center reflector 32 is disposed further at a focal point F2 of the secondary optics, and in this case, a projection lens 33 is used as the secondary optics. As for the light source used for providing light input to the reflector 32, a light emitting diode (LED) 31 may be selected and positioned at a focal point F1 of the reflector 32.

In FIG. 3, lines with arrows are also included so as to show schematically how the light emitted from the LED 31 propagates within the automotive lighting system 30. As can be seen, light as emitted from the LED 31 is firstly incident on the reflector 32. After being reflected by the reflector 32, the reflected light is then going to impinge onto the secondary projection lens 33, where the projection lens 33 is configured to project the light as received from the reflector onto a road in front of the vehicle. It should be pointed out that all the lines with arrows as depicted in FIG. 3 are only used to represent schematically, but not necessarily accurately, the propagation path of light. In practical implementations, the actual light path is dependent not only on the positions of various components such as LED 31, reflector 32, and projection lens 33, but also on the structural and/or optical parameters thereof, such as the curvature and/or reflectivity at different portions of the reflector 32. In other words, the portion of beam pattern as reflected by the center reflector 32 and projected then by the projection lens 33 are determined by any of the above mentioned factors, either individually or in any combination. This should be easily understood by a skilled person in the art. Therefore, the portion of beam pattern, corresponding to such as the center reflector 32, as desired in shape and/or light distribution, can be obtained, for example, by selecting suitable curvatures and/or reflectivity for different parts of the reflector 32. In a preferred embodiment of the present invention, the reflector 32 can be designed to be a freeform, and possibly curved, reflector 32, whose structural and optical parameters help to project more light onto the road near the vehicle than in the far field. In this way, a desirable low beam pattern is facilitated, while still avoiding glare for the drivers of oncoming cars.

According to an optional embodiment of the present invention, the LED 31 as shown in FIG. 3 can be further configured to be rotatable, for example around a rotation axis thereof perpendicular to an optical axis of the projection lens 33. Alternatively, the LED 31 is rotatable around an axis being parallel to an extension direction of the array of reflectors 32, i.e., an axis passing through the LED 31 itself and being perpendicular to the paper as shown in FIG. 3. Rotating the LED 31 in this way helps to find an optimal orientation of the LED 31 relative to the reflector 32 such that light emitted from the LED 31 is maximally incident onto the reflector 32. In this case, an improved and further maximized utilization of light is allowed. Although only one LED 31 is shown in FIG. 3 in connection with its corresponding reflector 32, the above described rotation of LED 31 can be applied to any other light sources in the entire lighting system 30. After rotation, light emitted from each and every light source in the whole system 30 will be used efficiently, contributing to a high efficiency of the automotive lighting system 30.

Figure 4A:
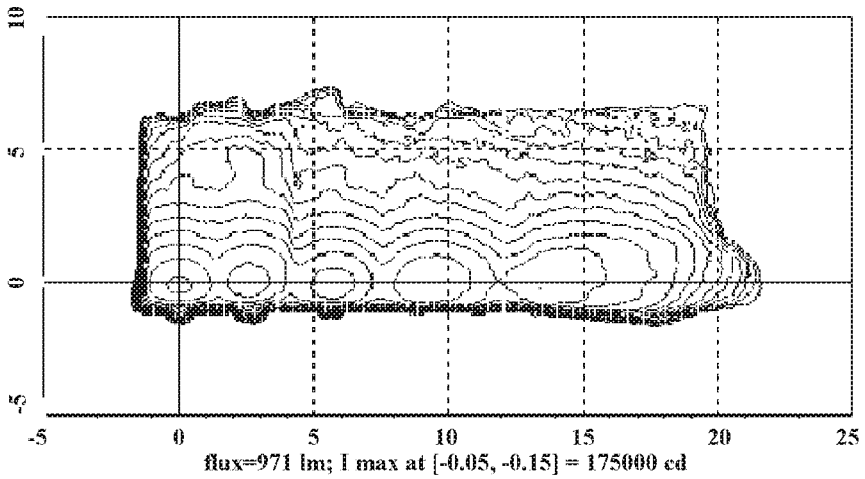
Figure 4B:
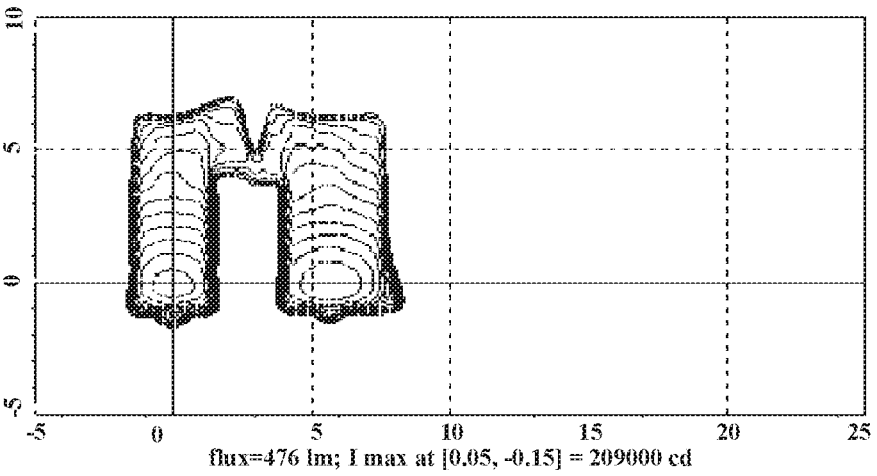

As mentioned above in the previous section and referring back to FIG. 2, one or more of the light sources 21 may not emit light due to receipt of a turn-off signal from a switching circuit (not shown in the figures). In this case, one or more of the primary optics 22 as arranged in a matrix, such as in an array of FIG. 2, corresponding to those turned-off light sources 21, will not receive sufficient light input, and thus reflect little or none light towards the secondary optics 23. If this is the case, the part of beam pattern, which would otherwise originate from the turned-off light sources 21, now becomes missing in the final projected beam pattern, leading to a crack or gap with no or little light distribution therein. This is illustrated schematically in FIGS. 4(*a*) and 4(*b*), wherein FIG. 4(*a*) schematically shows a simulated light intensity distribution as projected into the far field when all the light sources keep turned-on, and FIG. 4(*b*) schematically shows a simulated light intensity distribution as projected into the far field when only two light sources in the array are emitting light. Please note that isolines for the light intensity are used in FIGS. 4(*a*) and 4(*b*) to show how the intensity is distributed across the far field, where the highest light intensity is located at the lower left corner, and the light intensity decreases gradually with an increasing distance from the left lower edge. Further, a skilled person will easily understand as well that in both FIGS. 4(*a*) and 4(*b*), only a right part of the final beam pattern is depicted for the purpose of clarity. In practical applications, the full beam pattern as projected finally into the far field shall also contain a left part, being formed in an analogous way to the right part. In the present description, for the sake of simplicity, discussions are only given with regard to the right part of the beam pattern. By comparing the light intensity distributions or beam patterns as shown in FIGS. 4(*a*) and 4(*b*), the original rectangle and intact beam pattern with all the light sources turned-on will be transformed into only two bright strips which are spaced up and contain contributions from each of the two turned-on light sources. Therefore, freedom or flexibility will be given in terms of the shape or intensity distribution of the final beam pattern, for example by introducing a switching circuit such that one or more light sources can be turned off as desired. It should be easily understood by those skilled in the art having benefited from the present disclosure, various positions and/or constructions can be used for the above mentioned switching circuit, and the present invention is never going to be limited in this regard.

To sum up, the present invention is focused on providing an automotive lighting system for a vehicle, which automotive lighting system has fewer components, a simper structure, and higher performance or efficiency as compared with the traditional approach where not only a complex optical structure but also a significant loss of light is involved. The objective is accomplished by incorporating a simple, light redirecting element instead of a complex, bulk transmissive portion such that not only the difficulty and great efforts as required for preparing the transmissive portion is avoided, but also an improved and high efficiency and performance are guaranteed.

It should be noted that various components or elements as shown in the figures are not drawn to scale. Besides, relative positions between various components or elements as shown in the figures are only used to illustrate the basic principle of the present invention, and should not be considered to limit the spirit or protection scope of the present invention.

Further, it should be noticed that the above-mentioned embodiments illustrate rather than limit the present invention, and that those skilled in the art will be able to design many alternative embodiments without departing from the scope and spirit of the present invention. Although the present invention has been described in connection with some embodiments, it is not intended to be limited to the specific forms as set forth herein. Rather, the scope of the present invention is defined only by the accompanying claims. Additionally, although features may appear to be described in connection with particular embodiments, those skilled in the art would recognize that various features of the described embodiments may be combined in accordance with the disclosure of the present invention.

Furthermore, although individual features may be included in different claims, they may possibly be advantageously combined, and the inclusion in different claims does not imply that a combination of features is not feasible and/or advantageous. Also, the inclusion of a feature in one category of claims does not imply a limitation to this category, but rather indicates that the feature is equally applicable to other claim categories as appropriate.

In the claims, any reference signs placed between parentheses should not be construed as limiting the claims. Use of the verb "comprise" and its conjugations does not exclude the presence of elements or steps other than those stated in a claim. The article "a" or "an" preceding an element does not exclude the presence of a plurality of such elements. The mere fact that certain measures are recited in mutually different dependent claims does not indicate that a combination of these measures cannot be used to advantage.

The invention claimed is:

1. An automotive lighting system for a vehicle, comprising:

a plurality of light sources on a first optical axis;

a plurality of primary reflective optics in a matrix and configured to receive and redirect light from the plurality of light sources, each of the plurality of light sources being at a focal point of a corresponding one of the plurality of primary optics with each of the plurality of light sources in a focal plane of the corresponding one of the plurality of primary optics, the plurality of primary optics being configured to fold a direction of the propagation of the light from the plurality of light sources; and a secondary optic on a second optical axis and oriented in a different plane than the first optical axis, the secondary optic configured to receive the folded light from the plurality of primary optics and project the received light in front of the vehicle, with at least one of the plurality of primary optics in a focal plane of the secondary optic.

2. The automotive lighting system according to claim 1, wherein the secondary optic comprises a projection lens.

3. The automotive lighting system according to claim 1, wherein one of the plurality of primary optics is disposed at a focal point of the secondary optic.

4. The automotive lighting system according to claim 3, wherein the other ones of the plurality of primary optics are all disposed in the focal plane of the secondary optic.

5. The automotive lighting system according to claim 1, wherein the reflector of at least one of the plurality of primary optics has a shape of a paraboloid with a rectangle contour.

6. The automotive lighting system according to claim 5, wherein the rectangle contour has a side length in a range of 3-15 mm.

7. The automotive lighting system according to claim 1, wherein at least one of the plurality of light sources is rotatable for maximizing light emitted therefrom and impinging onto the plurality of primary optics.

8. The automotive lighting system according to claim 7, wherein the at least one rotatable one of the plurality of light sources is rotatable around an axis parallel to a row or column of the matrix of primary optics.

9. The automotive lighting system according to claim 1, further comprising:

a switching circuit configured to turn off one or more of the plurality of light sources such that no light is emitted therefrom.

10. The automotive lighting system according to claim 1, wherein at least one of the plurality of primary optics has a focal length in a range of 5-10 mm.

11. The automotive lighting system according to claim 1, wherein the secondary optic has a focal length in a range of 30-50 mm.

12. The automotive lighting system according to claim 1, wherein at least one of the plurality of light sources comprises one or more sub-light sources.

13. The automotive lighting system according to claim 1, wherein the folding of the light enables the lighting system size to be reduced.

14. The automotive lighting system according to claim 1, wherein the folding of the light enables the lighting system size to be comp act.

* * * * *